US012528622B1

(12) United States Patent
Dong

(10) Patent No.: US 12,528,622 B1
(45) **Date of Patent: *Jan. 20, 2026**

(54) THERMAL INSULATION CANISTER

(71) Applicant: Hangzhou Endoom Technology Co., Ltd., Zhejiang (CN)

(72) Inventor: Dong Dong, Zhejiang (CN)

(73) Assignee: Hangzhou Endoom Technology Co.,Ltd., Hangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 19/021,081

(22) Filed: Jan. 14, 2025

Related U.S. Application Data

(63) Continuation-in-part of application No. 18/972,501, filed on Dec. 6, 2024, now Pat. No. 12,358,699.

(51) Int. Cl.

| | |
|---|---|
| ***B65D 43/02*** | (2006.01) |
| ***B65D 39/12*** | (2006.01) |
| ***B65D 51/16*** | (2006.01) |
| ***B65D 51/24*** | (2006.01) |

(Continued)

(52) U.S. Cl.
CPC ..... *B65D 43/0218* (2013.01); *B65D 39/12* (2013.01); *B65D 51/1644* (2013.01); *B65D 51/243* (2013.01); *B65D 53/02* (2013.01); *B65D 81/3811* (2013.01); *B65D 2543/00092* (2013.01); *B65D 2543/00231* (2013.01); *B65D 2543/005* (2013.01); *B65D 2543/00537* (2013.01); *B65D 2543/00555* (2013.01);

(Continued)

(58) Field of Classification Search
CPC ..... B65D 43/0218; B65D 51/1644; B65D 51/243; B65D 53/02; B65D 81/3811; B65D 2543/00092; B65D 2543/00231; B65D 2543/005; B65D 2543/00537; B65D 2543/00555; B65D 2543/00879; B65D 2543/00972; B65D 39/12
USPC ..... 220/234–238, 259.2, 592.2, 592.7; 215/359; 138/89, 90
See application file for complete search history.

(56) References Cited

U.S. PATENT DOCUMENTS

| | | | | |
|---|---|---|---|---|
| 8,807,370 | B2 * | 8/2014 | Lee | B65D 45/327 220/378 |
| 2014/0054301 | A1 * | 2/2014 | Guoqing | B65D 51/242 220/521 |

(Continued)

FOREIGN PATENT DOCUMENTS

| | | | | |
|---|---|---|---|---|
| CN | 212213347 U | * | 12/2020 | A45F 3/16 |
| CN | 217075381 U | * | 7/2022 | B65D 25/2858 |

*Primary Examiner* — Nathan J Jenness
*Assistant Examiner* — Madison L Poos

(57) ABSTRACT

A thermal insulation canister includes a canister body and a thermal insulation cover. The thermal insulation cover is covered on the canister body. The thermal insulation cover includes an upper cover body, a sealing ring, an adjusting frame and a trigger, the upper cover body is configured to protect an internal structure of the thermal insulation cover. The adjusting frame is rotatably connected to the trigger through the upper cover body. The sealing ring is provided between the upper cover body and the adjusting frame. The adjusting frame is driven by the rotating trigger to compress the sealing ring, which deforms to the side and abuts against the canister body, the sealing ring deforms to the side of the canister body and abuts against the canister body.

17 Claims, 10 Drawing Sheets

(51) Int. Cl.
*B65D 53/02* (2006.01)
*B65D 81/38* (2006.01)

(52) U.S. Cl.
CPC ..... *B65D 2543/00879* (2013.01); *B65D 2543/00972* (2013.01)

(56) References Cited

U.S. PATENT DOCUMENTS

2021/0053731 A1* 2/2021 Lane ..... B65D 41/465
2021/0269200 A1* 9/2021 Ou ..... B65D 51/242

* cited by examiner

THERMAL INSULATION CANISTER

CROSS-REFERENCE TO RELATED APPLICATIONS

This application is a Continuation-in-Part of the U.S. application Ser. No. 18/972,501 filed on Dec. 6, 2024, and entitled "THERMAL INSULATION CANISTER" now pending, which is incorporated herein by reference in its entireties.

TECHNICAL FIELD

The present invention relates to the technical field of thermal insulation containers, in particular to a thermal insulation canister.

BACKGROUND

Existing thermal insulation canisters usually adopt two fixed methods for the connection between the thermal insulation cover and the canister body namely screw threads and quick-opening mechanisms. For the screw thread fixing method, screw threads need to be set on both the thermal insulation cover and the canister body. When cleaning the thermal insulation canister, it is rather difficult to clean the impurities in the screw thread gaps. Moreover, after the internal temperature of the thermal insulation canister drops, the air pressure difference between the inside and outside of the thermal insulation canister will make it hard to open the cover of the canister. Meanwhile, the disadvantage of the existing quick-opening thermal insulation canisters is that the locking force is insufficient. The covers may be pushed open by the steam generated from high-temperature food liquids and thus fail to achieve a proper seal, especially in the case of canisters with large diameters, for this reason, the present invention provides a thermal insulation canister, which can effectively solve the above problems.

SUMMARY

In order to overcome the deficiencies of the prior art, the technical solutions adopted by the present invention to solve technical problems is following.

A thermal insulation canister includes a thermal insulation cover and a canister body, the thermal insulation cover is configured to cover the canister body. The thermal insulation cover includes an upper cover body, a sealing ring, an adjusting frame and a trigger, the upper cover body is configured to protect the internal structure of the thermal insulation cover. The adjusting frame passes through the upper cover body and is rotatably connected to the trigger. The sealing ring is located between the upper cover body and the adjusting frame. The trigger drives the adjusting frame to move and compress the sealing ring, then the sealing ring deforms toward one side of the canister body and abuts against the canister body.

Furthermore, the upper cover body is provided with an installation holes, the trigger is provided with a trigger connecting shaft, the trigger connecting shaft is positioned within the installation holes and is slidably connected to the installation holes. The adjusting frame is provided with an adjusting shafts, one end of the adjusting shaft passes through the installation holes and is rotatably connected with the trigger connecting shaft, the trigger is configured to drive the adjusting frame to move.

Furthermore, the trigger connecting shaft is provided with a protruding portion, when the trigger rotates, the protruding portion presses against an inner wall of the installation holes, and the trigger moves with the protruding portion as a fulcrum to drive the trigger to move along the trigger connecting shaft.

Furthermore, an upper end of the sealing ring is inserted and fixed with the lower end surface of the upper cover body, a lower end of the sealing ring is contacted with an upper end surface of the adjusting frame.

Furthermore, the lower end surface of the upper cover body is provided with an outer ring groove and an inner ring groove, an upper end of the canister body is inserted and fitted with the outer ring groove, and the sealing ring is inserted and fitted with the inner ring groove.

Furthermore, the adjusting frame includes an adjusting plate and a bottom plate, a thermal insulation layer is located in the adjusting frame, the thermal insulation layer is located between the adjusting plate and the bottom plate. The bottom plate is fastened on a lower end surface of the adjusting plate, a center of a lower end surface of the adjusting plate is provided with a hollow central shaft, the lower end surface of the adjusting plate is further provided with a plurality of spoke edges and annular edges, the plurality of spoke edges are arranged surrounding the central shaft, one end of the spoke edge is connected to the central shaft, the other end of the spoke edge extends to an outer edge of the adjusting plate, the annular edge connects the plurality of the spoke edges, the spoke edge and the annular edge are configured to increase firmness of the adjusting frame.

Furthermore, the thermal insulation cover further includes a pressure valve is configured to relieve pressure in the thermal insulation canister, and the pressure valve is located in the central shaft.

Furthermore, the thermal insulation cover further includes an inner cover body, a lower end surface of the inner cover body is provided with a sealing gasket, the sealing gasket have an arc-shaped outer side, a plurality of reinforcing edges are disposed on a lower end surface of the inner cover body, and the plurality of reinforcing edges are configured to increase strength of the inner cover body.

Furthermore, the canister body further includes an outer canister body and an inner canister body, the inner canister body is located in the outer canister body, the inner cover body is disposed on the upper end of the inner canister body, the inner cover body clamps with an inner wall of the canister body. An inner wall of the outer canister body is provided with a clamping edge protruding inward, an upper end of the inner canister body is provided with a retaining ring folded outward, an outer diameter of the retaining ring is greater than an inner circle diameter of the clamping edge, the retaining ring is in contact with the clamping edge.

Furthermore, the outer canister body further includes an outer casing and an inner casing, an interlayer thermal insulation layer is located between the outer casing and the inner casing, the clamping edge is disposed on the inner casing.

Furthermore, the upper end of the canister body is bent inward to form a clamping structure, when the sealing ring is compressed and deformed, the sealing ring is clamped and fixed with the clamping structure.

Furthermore, the clamping structure is plug-fitted into the outer ring groove.

Furthermore, the inner cover body further includes a lower cover plate and a lower annular sleeving plate, the lower annular sleeving plate is positioned on an upper end surface of the lower cover plate, a diameter of the lower cover plate is greater than a diameter of the lower annular sleeving plate, the sealing ring is in contact with an outside of the lower annular sleeving plate, and abuts with the upper end surface of the lower cover plate.

Furthermore, the lower annular sleeving plate is sleeved on an outside of the adjusting frame; an outer clamping stripes and an outer clamping block are fixedly arranged on an outer sidewall of the adjusting frame, the outer clamping stripes are arranged obliquely along the outer sidewall of the adjusting frame, the outer clamping block is arranged at the highest position of the outer clamping stripes, an inner wall of the lower annular sleeving plate is fixed with an inner clamping block, the inner clamping block and the outer clamping stripe are slidly connected, each of two sides of the inner clamping block and the outer clamping block is an inclined plane, the inner clamping block and the outer clamping block are connected, so that the adjusting frame and the inner cover body is detachably connected.

Furthermore, the upper cover body is further provided with a handle ring, and the handle ring is rotatably connected to the upper cover body.

Furthermore, an annular pad is embedded in a lower end surface of the outer casing, and the annular pad is fixedly connected to a lowermost end of the outer casing.

Furthermore, an upper end surface of the upper cover body is provided with a storage groove, the storage groove is configured to place at least one dinnerware.

Furthermore, the storage groove is provided with a storage cover, one side of the storage cover is rotatably connected to the storage groove, and the other side of the storage cover is fastened to the storage groove.

Beneficial effects of the present invention: the present invention provides thermal insulation canister that eliminate the need to open the lid using traditional modes such as threaded and quick release, using the trigger drives the adjusting frame to compress the sealing ring, the sealing ring deforms and presses against the inner wall of the canister body, which can generate friction to tighten the cover over the canister body, also takes into account better sealing, the pressure valve can give the thermal insulation canister pressure relief in time, the insulation irrigation will not produce a large pressure difference with the outside world, so that users can easily remove the thermal insulation cover, the design is simple and reasonable, the operation is convenient and fast, to provide users with a better experience of use. Each structure in this design can be completely separated, when you need to clean, you can rotate the lower cover body, the lower cover body and adjusting frame, seals and other parts can be separated in order to clean, easy to clean them.

BRIEF DESCRIPTION OF THE DRAWINGS

In order to more clearly illustrate the technical solutions in the embodiments of the present invention, the accompanying drawings to be used in the description of the embodiments will be briefly described below, the accompanying drawings in the following description are only some embodiments of the present invention, for ordinary person skilled in the art, other drawings obtained from these drawings without paying creative labor by an ordinary person skilled in the art should be within scope of the present disclosure.

The invention is further described below in connection with the accompanying drawings and embodiments.

DETAILED DESCRIPTION OF THE EMBODIMENTS

Figure 1:
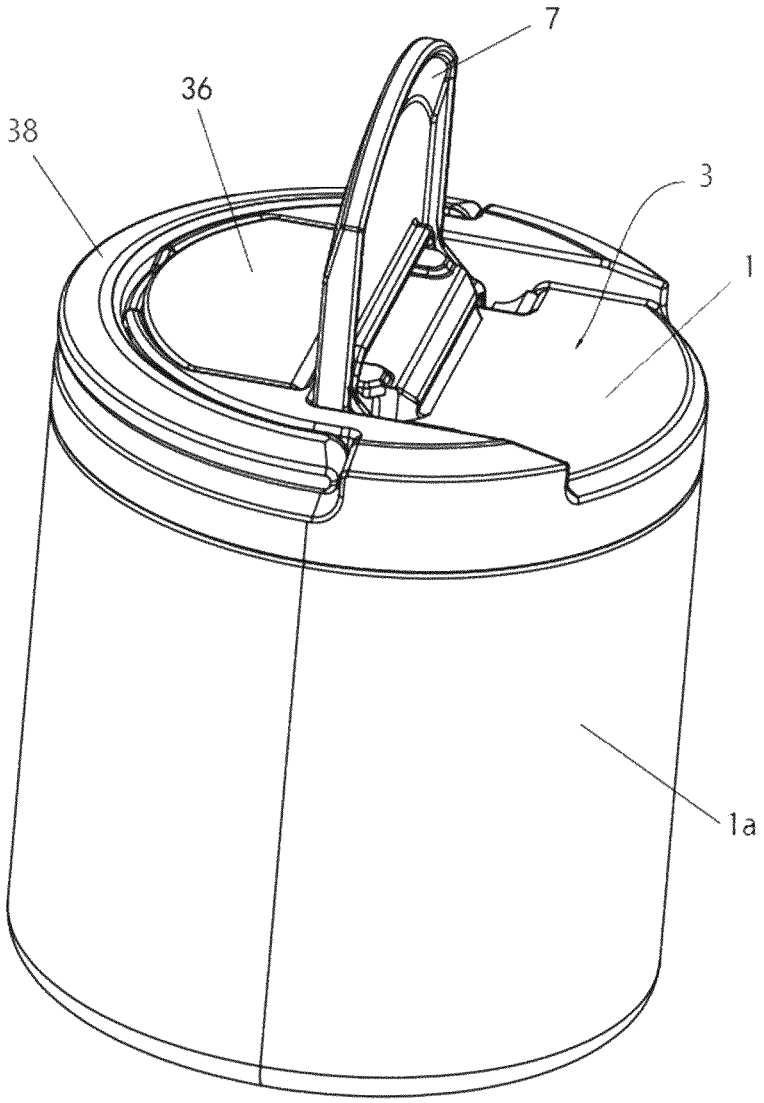
FIG. 1 is a schematic diagram structural according to Embodiment I.

The following is only the preferred embodiment of the present invention, and the scope of protection is not limited to this embodiment only. Furthermore, any technical solution that falls within the inventive concept of the present invention should belong to the scope of protection of the present invention. The same components are represented by the same reference numerals. It should be noted that the terms "front", "rear", "left", "right", "upper" and "lower" used in the following description refer to the directions in the drawings, and the terms "bottom" and "top", "inner" and "outer" respectively refer to the directions toward or away from the geometric center of a specific component.

Embodiment I

Figure 2:
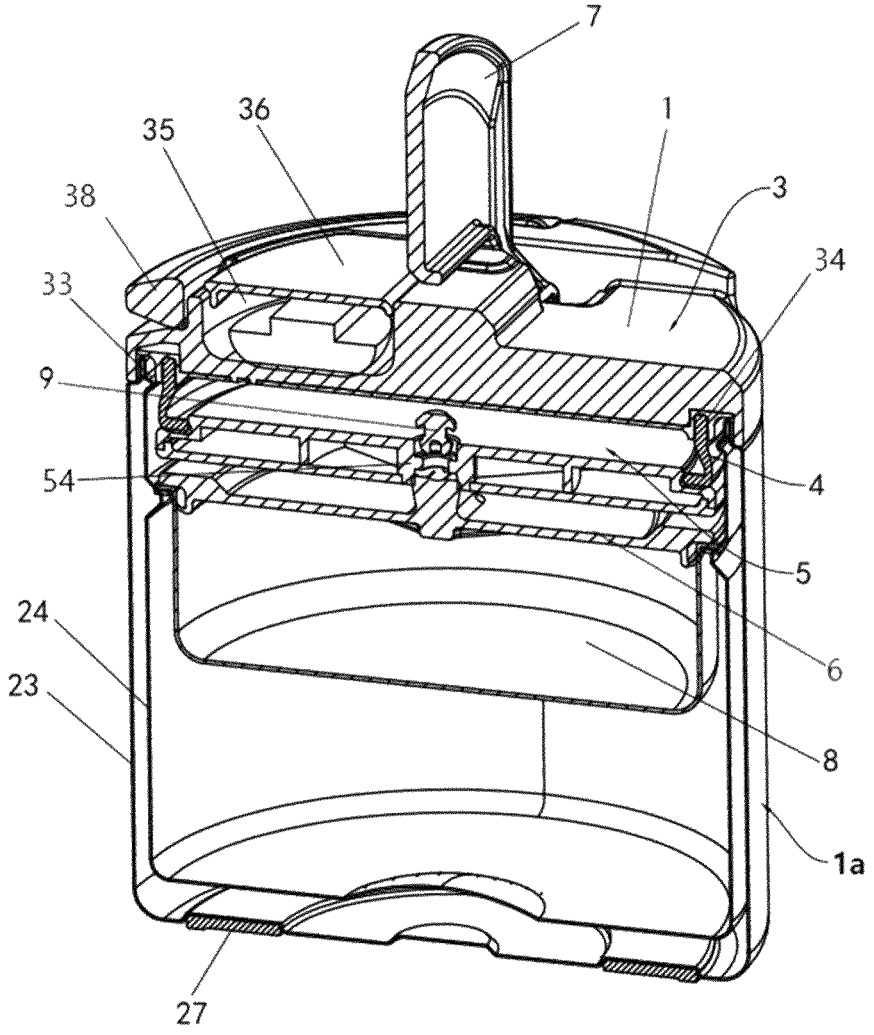
FIG. 2 is a sectional view according to Embodiment I.
Figure 3:
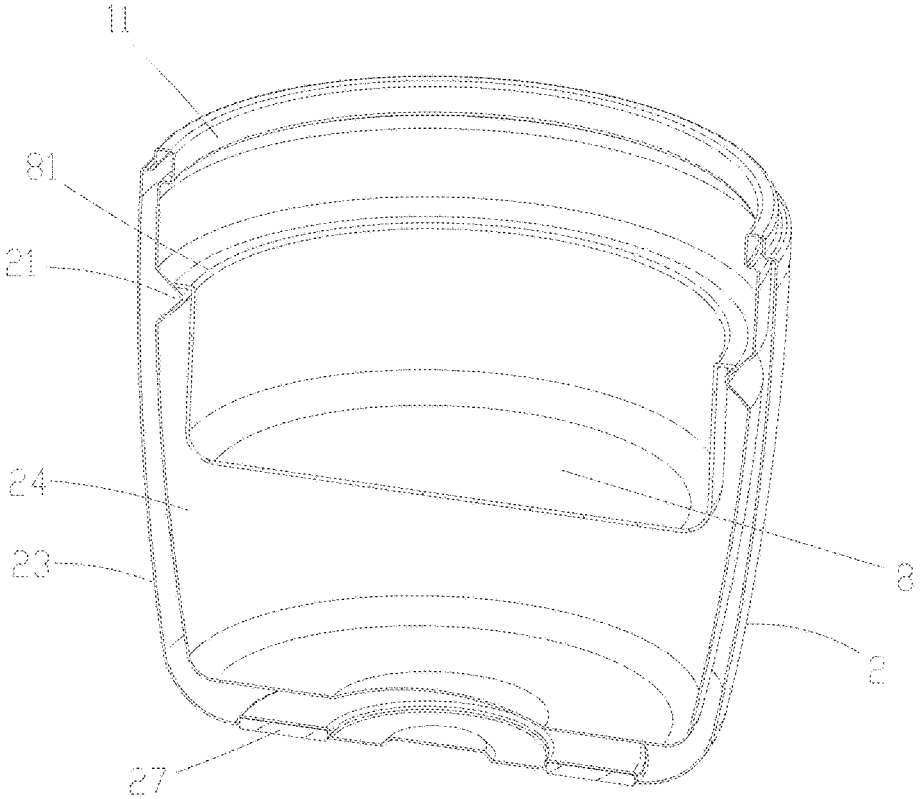
FIG. 3 is a sectional view of a canister body according to Embodiment I.
Figure 4:
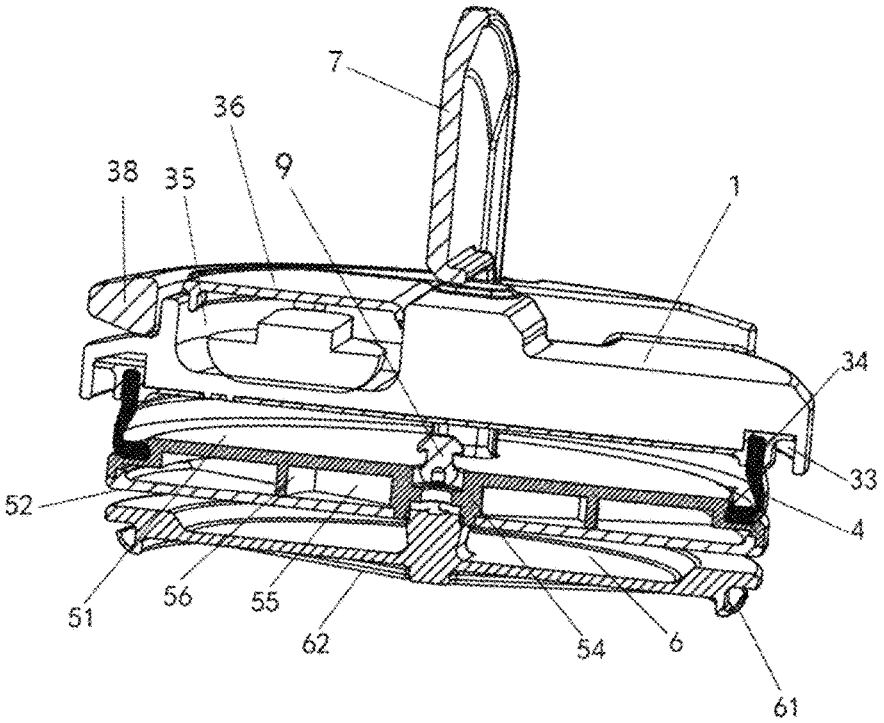
FIG. 4 is a sectional view of a thermal insulation cover according to Embodiment I.
Figure 5:
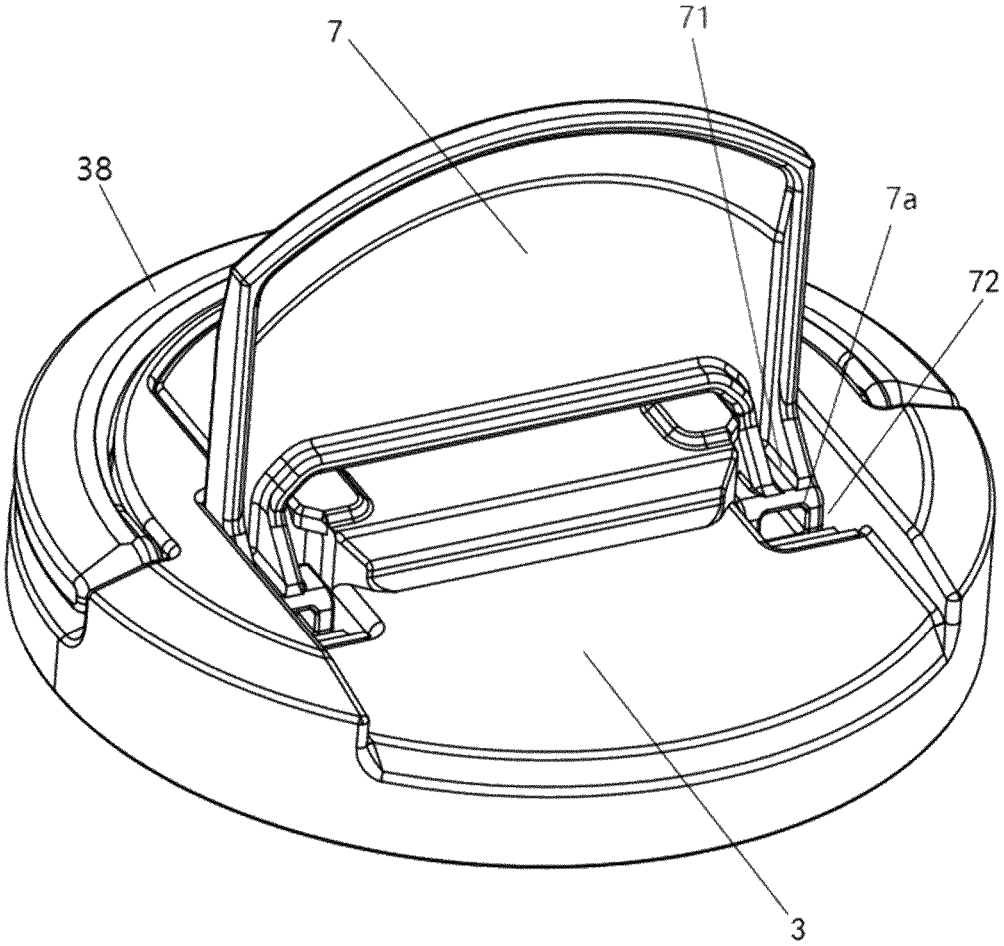
FIG. 5 is a schematic structural diagram of an upper cover body and a trigger according to Embodiment I.
Figure 6:
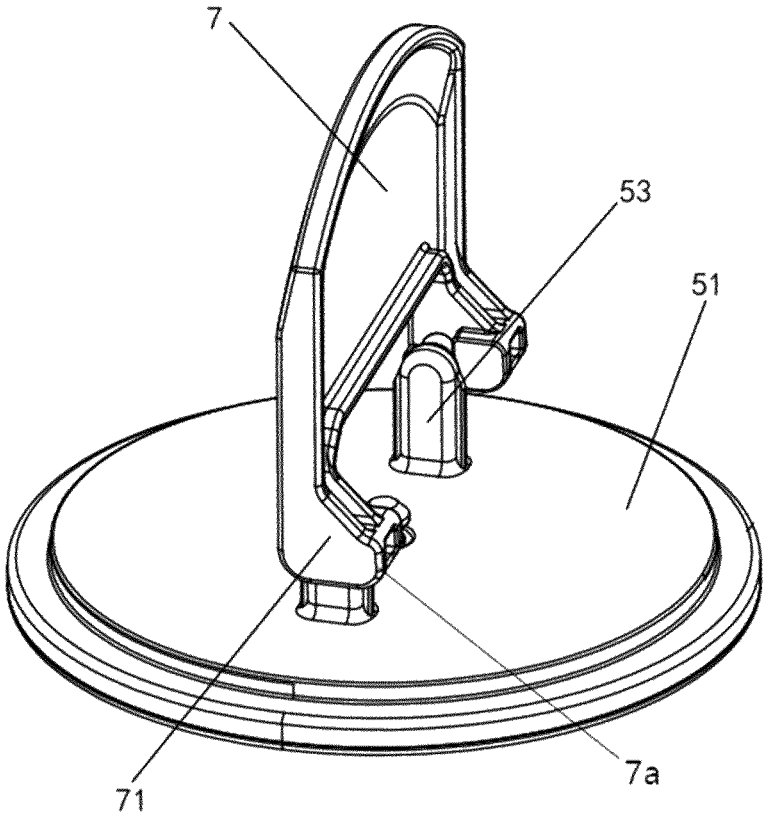
FIG. 6 is a schematic structural diagram of an adjusting frame and the trigger according to Embodiment I.
Figure 7:
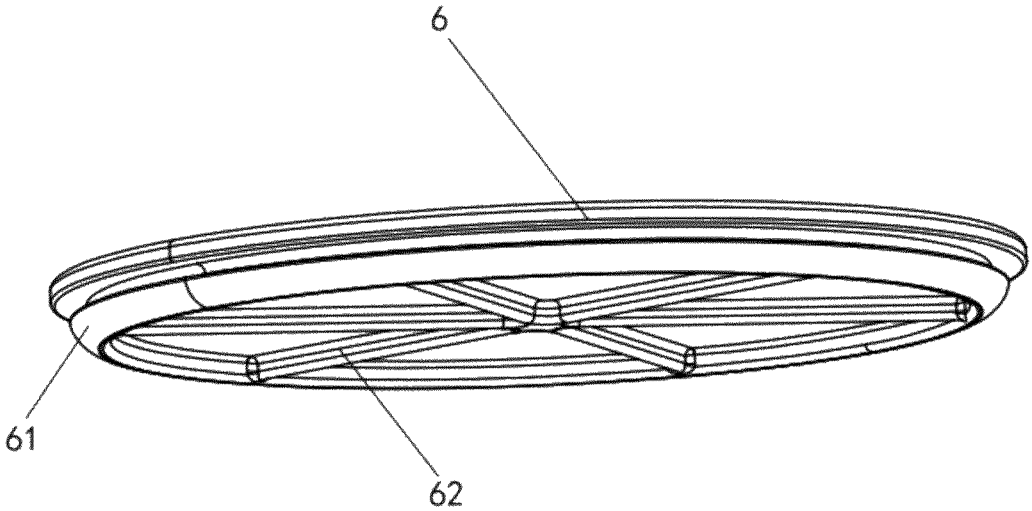
FIG. 7 is a schematic structural diagram of a lower inner cover body according to Embodiment I.

Referring to FIG. 1 to FIG. 7, a thermal insulation canister in Embodiment I includes a canister body 1*a* and a thermal insulation cover 1, the thermal insulation cover 1 covers the canister body 1*a*. The thermal insulation cover 1 includes an upper cover body 3, a sealing ring 4, an adjusting frame 5 and a trigger 7, the upper cover body 3 is configured to protect an inner structure of the thermal insulation cover 1. The adjusting frame 5 is configured pass through the upper cover body 3, one end of the sealing ring 4 is plugged and fixed with the upper cover body 3, the other end of the sealing ring 4 is in contact with the adjusting frame 5. The upper cover body 3 is provided with installation holes 72, the adjusting frame 5 is provided with the adjusting shafts 53, one end of the adjusting shafts 53 passes through the installation holes 72. The trigger 7 is provided with a trigger connecting shaft 71, one end of the trigger connecting shaft 71 is slidably installed in the installation holes 72 and is rotatably connected to the adjusting shaft 53.

The sealing ring 4 is made of elastic material, in this design it is made of silicone. When the trigger 7 is turned, the trigger connecting shaft 71 and the adjusting shaft 53 will drive the adjusting frame 5 to move up and down. When the adjusting frame 5 moves upward, the adjusting frame 5 compresses the sealing ring 4, causing the sealing ring 4 to deform outward, thereby pressing against the inner wall of the canister body 1*a*, the greater the deformation of the sealing ring 4, the greater the area of the sealing ring 4 contacts the canister body 1*a*, the greater the friction between the sealing ring 4 and the inner wall of the canister body 1*a*, so that the thermal insulation cover 1 and the canister body 1*a* are closely locked. On the contrary, when the adjusting frame 5 moves downward, the sealing ring 4 gradually returns to its original shape, the less friction there is between the sealing ring 4 and the inner side wall of the canister body 1*a*, then the users can easily remove the thermal insulation cover 1 from the canister body 1*a*.

The trigger connecting shaft 71 is provided with a protruding portion 7*a*, when the trigger 7 is rotated to one side, the protruding portion 7*a* presses against the inner wall of the installation holes 72, one end of the trigger 7 lifts upwardly with the protruding portion 7*a* as the pivot point, thereby driving the trigger connecting shaft 71 upwardly. When the trigger 7 is rotated to the other side, the trigger 7 moves downwardly with the protruding portion 7*a* as the pivot point, thereby driving the trigger connecting shaft 71 downwardly. The invention realizes control of movement of the adjusting frame 5 through the protruding portion 7*a* cooperates with the inner side wall of the installation holes 72, to realize the control of the movement of the adjusting frame 5, and the design is simple and practical.

A lower end surface of the upper cover body 3 is provided with an outer ring groove 33 and an inner ring groove 34, one end of the sealing ring 4 is inserted in the inner ring groove 34, an upper end of the canister body 1*a* is inserted in the outer ring groove 33 for increasing the overall air tightness.

The adjusting frame 5 includes an adjusting plate 51 and a bottom plate 52, the bottom plate 52 is fastened on the lower end surface of the adjusting plate 51, an interlayer thermal insulation layer is between the adjusting plate 51 and the bottom plate 52, which can increase the thermal insulation performance of the thermal insulation canister.

The center of the lower end surface of the adjusting plate 51 is provided with a hollow central shaft 54, the thermal insulation cover 1 includes a pressure valve 9 to relieve pressure to the thermal insulation canister, the pressure valve 9 is slidably installed inside the central shaft 54, in order to prevent the gas pressure inside the canister body 1*a* is too large to cause damage to the canister body 1*a*, the pressure valve 9 is installed on the center shaft 54 of the adjusting frame 5, when the gas pressure inside the canister body 1*a* exceeds a certain value, the pressure valve 9 is opened, so that the gas inside the canister body 1*a* can pass through from the adjusting frame 5, to relieve the pressure, at the same time it is also convenient for the users to remove the thermal insulation cover 1.

The lower end surface of the adjusting plate 51 is also provided with a plurality of spoke edges 55 and annular edges 56, the spoke edges 55 are arranged surrounding the central shaft 54, one end of the spoke edge 55 is connected to the central shaft 54, the other end of the spoke edge 55 extends to an outer edge of the adjusting plate 51, the annular edge 56 connects all of the spoke edges 55, the spoke edges 55 and the annular edge 56 can increase the firmness of the adjusting frame 5.

The canister body 1*a* includes an inner canister body 8 and an outer canister body 2, the inner canister body 8 located in the outer canister body 2, the inner canister body 8 and the outer canister body 2 are convenient for users to hold different foods. The inner canister body 8 clamps to an inner wall of the canister body 1*a*. An inner wall of the outer canister body 2 is provided with a clamping edges 21 protruding inward, the inner canister body 8 is provided with a retaining ring 81 folded outward, an outer diameter of the retaining ring 81 is greater than an inner circle diameter of the clamping edges 21, the retaining ring 81 is in contact with the clamping edges 21, the inner canister body 8 and the outer canister body 2 are detachably connected, the users can take out the inner canister body 8 and use the outer canister body 2 to hold more foods, providing the users with more options.

The thermal insulation cover 1 further includes an inner cover body 6, the inner cover body 6 is clamped below the adjusting frame 5, the inner cover body 6 is covered and fixed on the inner canister body 8, a lower end surface of the inner cover body 6 is provided with a circle of a sealing gasket 61, an outer side of the sealing gasket 61 is arc-shaped, when the inner cover body 6 is covered and fixed on the inner canister body 8, the sealing gasket 61 is in contact with the inner wall of the inner canister body 8, which can increase the air tightness and heat preservation performance of the inner canister body 8, at the same time to prevent the food in the inner canister body 8 from mixing odors with the foods in the outer canister body 2. The plurality of reinforcing edges 62 are disposed on the lower end surface of the inner cover body 6, the reinforcing edges 62 can increase the strength of the inner cover body 6.

The upper end of the canister body 1*a* is bent inward to form a clamping structure 11, when the sealing ring 4 is compressed and deformed, that is clamped and fixed with the clamping structure 11, the clamping structure 11 is configured to prevent the sealing ring 4 from moving and lock the thermal insulation cover 1 with the canister body 1*a*. One end of the clamping structure 11 is inserted in the outer ring groove 33, so that the thermal insulation cover 1 is plugged into the canister body 1*a* to further increase the air tightness.

The outer canister body 2 includes an outer casing 23 and an inner casing 24, and an interlayer thermal insulation layer is arranged between the outer casing 23 and the inner casing 24 as a spacer layer, the foods inside the canister body 1*a* can be better insulated. Both of the outer casing 23 and the inner casing 24 are made of food-grade stainless steel, which can increase the safety of holding foods. A plastic layer will be provided on an outer wall of the outer casing 23 for thermal insulation and increase the thermal insulation of the canister body 1*a* itself. The clamping edges 21 are disposed on the inner casing 24.

The upper cover body 3 is provided with a handle ring 38. The handle ring 38 is rotatably connected to the upper cover body 3, it allows the users to pick up the thermal insulation canister by carrying, which makes the thermal insulation canister more convenient to carry.

An annular pad 27 is embedded in the lower end surface of the outer casing 23, the annular pad 27 is made of a heat-insulating and elastic material such as rubber, which can reduce collisions between the outer casing 23 and external objects such as tables, thereby prolonging the service life of the thermal insulation canister.

The upper cover body 3 is provided with a storage groove 35, the storage groove 35 can be configured to place dinnerware, snacks, etc. The storage groove 35 is provided with a storage cover 36, one side of the storage cover 36 is hinged to the storage groove 35, and the other side of the storage cover 36 is clamped to the storage groove 35. After the storage cover 36 is covered on the storage groove 35, the storage cover 36 can prevent the objects in the storage groove 35 from falling out.

Embodiment II

Figure 8:
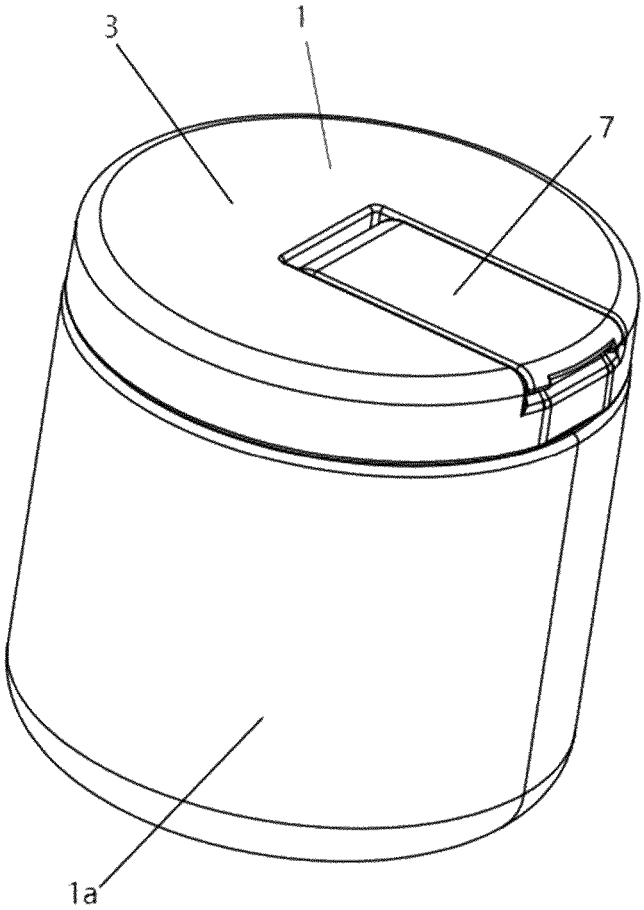
FIG. 8 is a schematic structural diagram when the trigger is closed according to Embodiment II.
Figure 9:
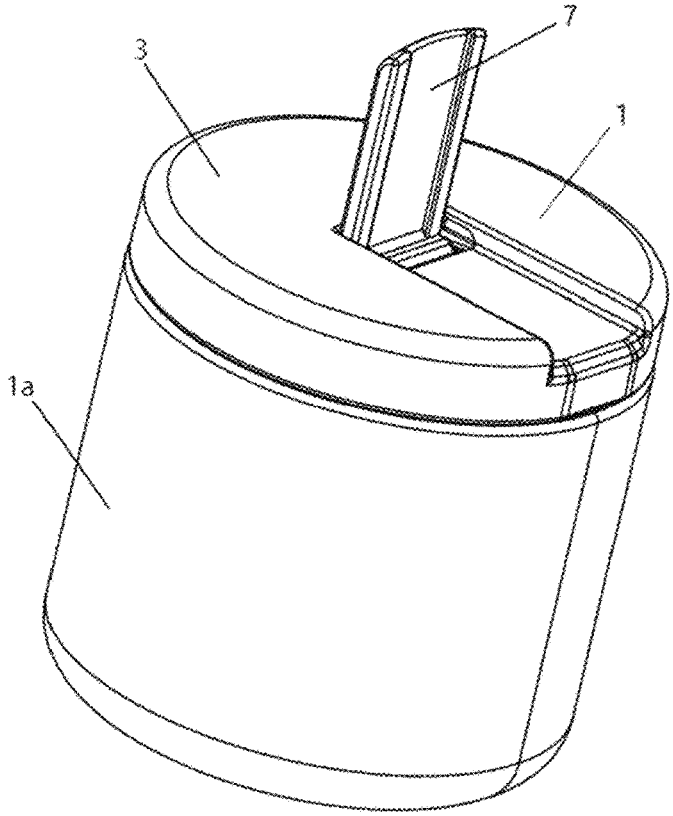
FIG. 9 is a schematic structural diagram when the trigger is opened according to Embodiment II.
Figure 10:
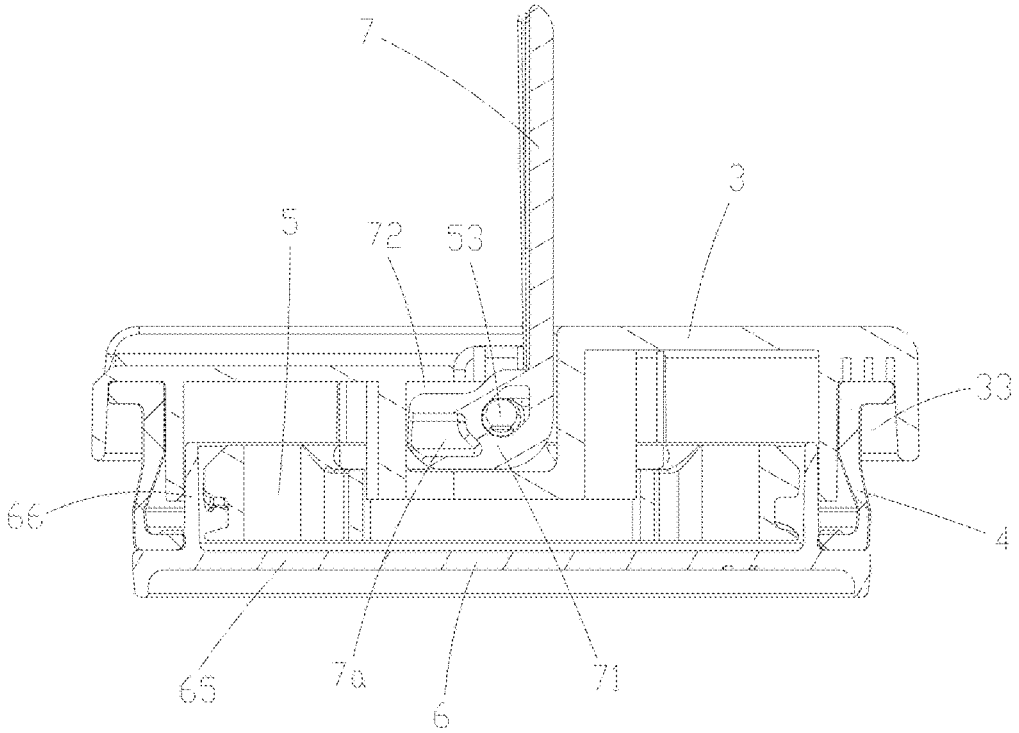
FIG. 10 is a sectional view of a thermal insulation cover according to Embodiment II.
Figure 11:
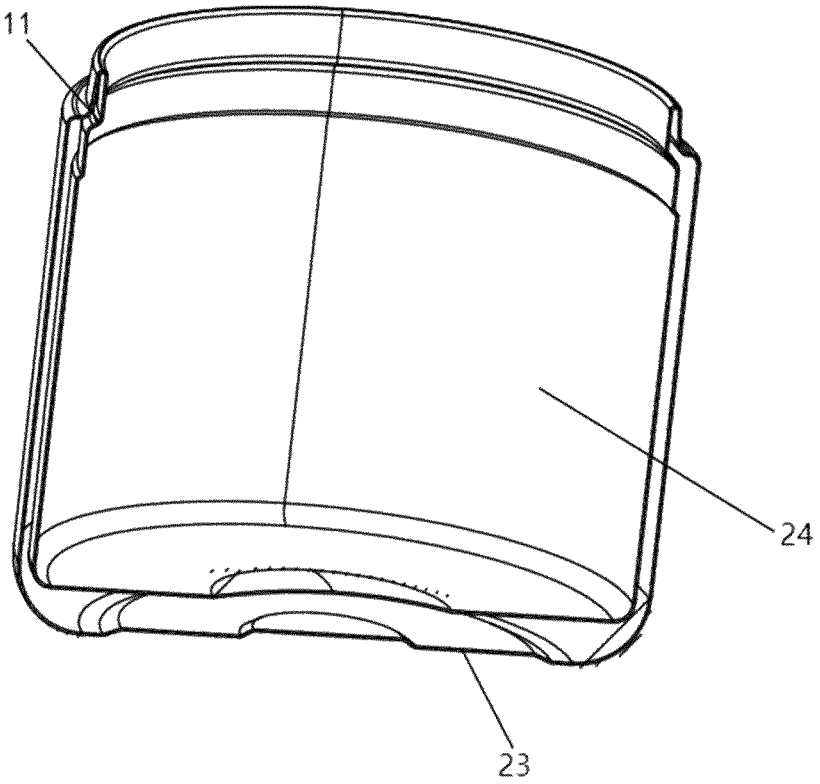
FIG. 11 is a sectional view of a canister body according to Embodiment II.
Figure 12:
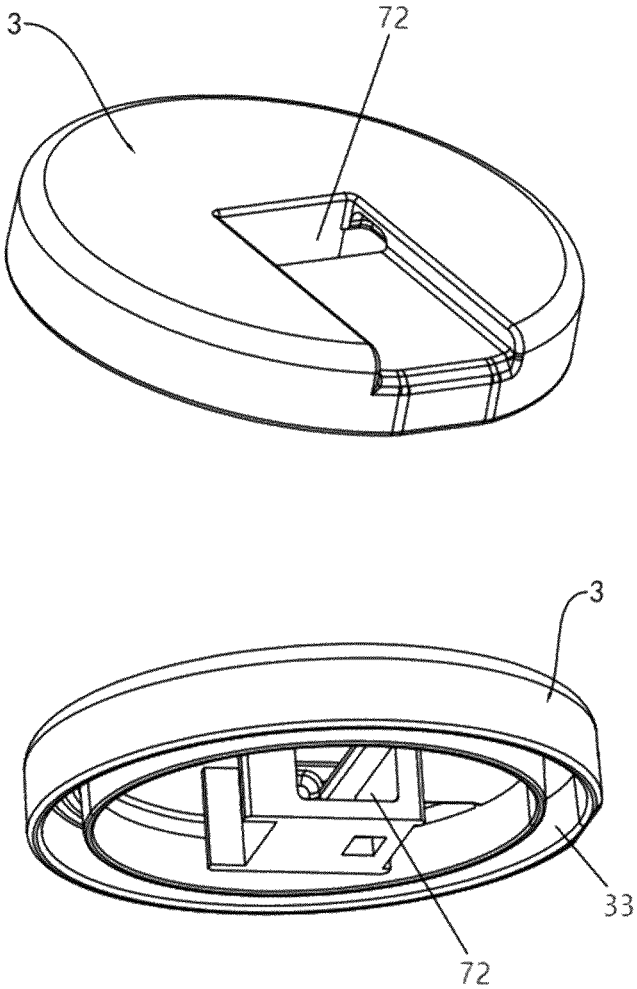
FIG. 12 is a schematic structural diagram of the upper cover body in two orientations according to Embodiment II.
Figure 13:
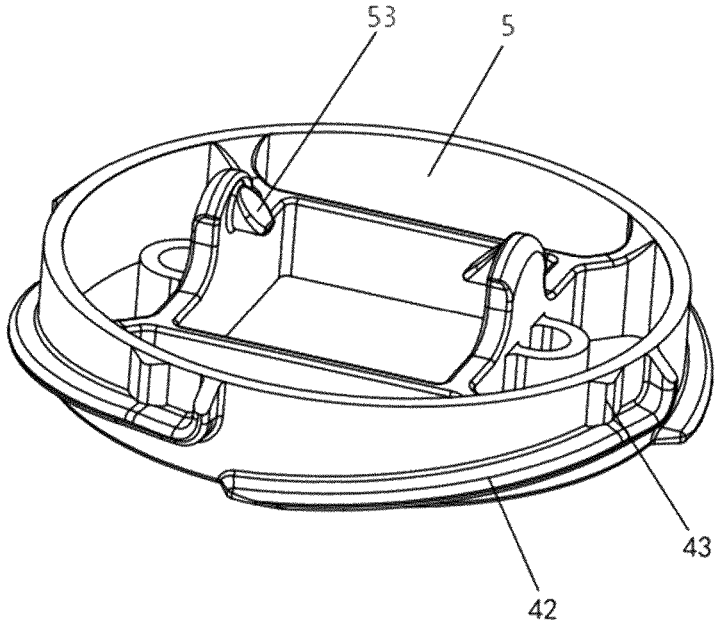
FIG. 13 is a schematic structural diagram of the adjusting frame according to Embodiment II.
Figure 14:
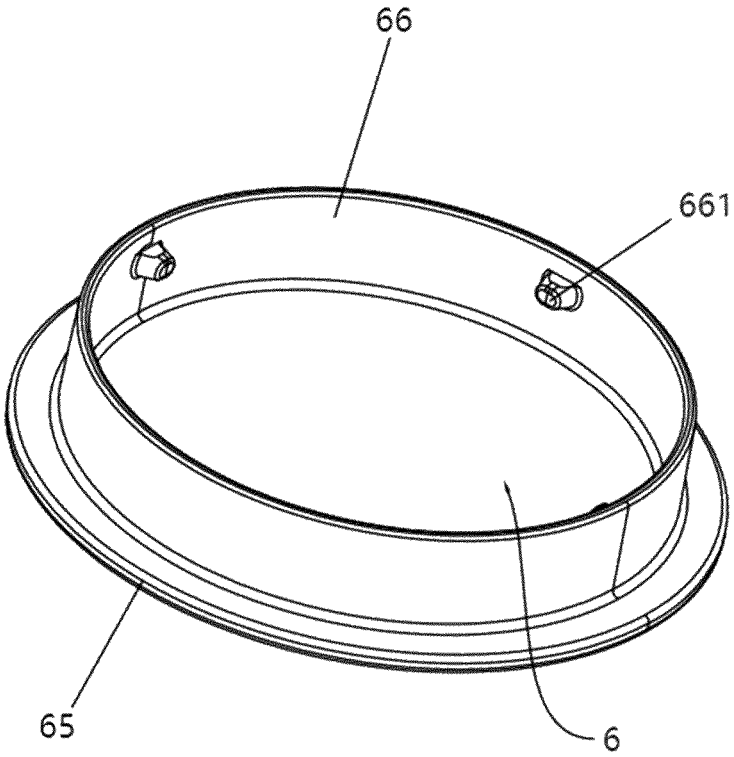
FIG. 14 is a schematic structural diagram of a lower cover body according to Embodiment II.

Referring to FIG. 8 to FIG. 14, the present invention also provides Embodiment II, a kind of thermal insulation canister, includes a canister body 1*a* and a thermal insulation cover 1, the thermal insulation cover 1 covers the canister body 1*a*. The thermal insulation cover 1 includes an upper cover body 3, a sealing ring 4, an adjusting frame 5, a trigger 7 and an inner cover body 6, the adjusting frame 5 is configured underneath the upper cover body 3, one end of the sealing ring 4 is plugged and fixed with the upper cover body 3, the other end of the sealing ring 4 is in contact with the inner cover body 6. The upper cover body 3 is provided with installation holes 72, the adjusting frame 5 is provided with the adjusting shafts 53, one end of the adjusting shafts 53 passes through the installation holes 72, the trigger 7 is provided with a trigger connecting shaft 71, one end of the trigger connecting shaft 71 is slidably installed in the installation holes 72 and is rotatably connected to the adjusting shaft 53.

The sealing ring 4 is made of elastic material, in this design it is made of silicone. When the trigger 7 is turned, the trigger connecting shaft 71 and the adjusting shaft 53 will drive the adjusting frame 5 to move up and down, when the adjusting frame 5 moves upward, the inner cover body 6 compresses the sealing ring 4, causing the sealing ring 4 to deform outward, thereby pressing against the inner wall of the canister body 1*a*, the greater the deformation of the sealing ring 4, the greater the area of the sealing ring 4 contacts the canister body 1*a*, the greater the friction between the sealing ring 4 and the inner wall of the canister body 1*a*, so that the thermal insulation cover 1 and the canister body 1*a* are closely locked. On the contrary, when the inner cover body 6 moves downward, the sealing ring 4 gradually returns to its original shape, the less friction there is between the sealing ring 4 and the inner side wall of the canister body 1*a*, then the users can easily remove the thermal insulation cover 1 from the canister body 1*a*.

The trigger 7 is provided with a protruding portion 7*a*, when the trigger 7 is rotated to one side, the protruding portion 7*a* presses against the inner wall of the installation holes 72, one end of the trigger 7 lifts upwardly with the protruding portion 7*a* as the pivot point, thereby driving the trigger connecting shaft 71 upwardly. When the trigger 7 is rotated to the other side, the trigger 7 moves downwardly with the protruding portion 7*a* as the pivot point, thereby driving the trigger connecting shaft 71 downwardly.

A lower end surface of the upper cover body 3 is provided with an outer ring groove 33, one end of the sealing ring 4 and the upper of the canister body 1*a* are inserted in the outer ring groove 33, for increasing the overall air tightness.

The upper cover body 3 includes a lower cover plate 65 and a lower annular sleeving plate 66, the lower annular sleeving plate 66 is arranged around an upper end surface of the lower cover plate 65, a diameter of the lower cover plate 65 is greater than a diameter of the lower annular sleeving plate 66, the sealing ring 4 abuts an outer side of the lower annular sleeving plate 66, and abuts the upper end surface of the lower cover plate 65.

The lower annular sleeving plate 66 is sleeved on the outside of the adjusting frame 5, which can save space, an outer side wall of the adjusting frame 5 is provided with an inclined outer clamping stripes 42 and an outer clamping block 43, the outer clamping block 43 is arranged at the highest position of the outer clamping stripes 42, an inner wall of the lower annular sleeving plate 66 is provided with an inner clamping block 661, the adjusting frame 5 is placed on the inner cover body 6, when it is rotated, the inner clamping block 661 can slide along the outer clamping stripes 42, since the outer clamping strips 42 is inclined, when the adjusting frame 5 is rotated to the right, the adjusting frame 5 gradually approaches the inner cover body 6, until the outer clamping block 43 and the inner clamping block 661 are engaged, the adjusting frame 5 and the inner cover body 6 reaches a locked state. When the adjusting frame 5 is rotated to the left, the inner clamping block 661 slides on the outer clamping strip 42, until it leaves the outer clamping stripes 42, so that the adjusting frame 5 and the inner cover body 6 are detachably connected, with simple structural design and high durability.

The upper end of the canister body 1*a* is bent inward to form a clamping structure 11, when the sealing ring 4 is compressed and deformed, that is clamped and fixed with the clamping structure 11, the clamping structure 11 is configured to prevent the sealing ring 4 from moving and lock the thermal insulation cover 1 with the canister body 1*a*. One end of the clamping structure 11 is inserted in the outer ring groove 33, so that the thermal insulation cover 1 is plugged into the canister body 1*a* to further increase the air tightness.

The canister body 1*a* includes an outer canister body 2, the outer canister body 2 includes an outer casing 23 and an inner casing 24, an interlayer thermal insulation layer is arranged between the outer casing 23 and the inner casing 24, the foods inside the canister body 1*a* can be better insulated. Both of the outer casing 23 and the inner casing 24 are made of food-grade stainless steel, which can increase the safety of holding foods. A plastic layer will be provided on the outer wall of the outer casing 23 for thermal insulation and increase the thermal insulation of the canister body 1*a* itself.

The present invention provides thermal insulation canister that eliminate the need to open the lid using traditional modes such as threaded and quick release, using the trigger drives the adjusting frame to compress the sealing ring, the sealing ring deforms and presses against the inner wall of the canister body, which can generate friction to tighten the cover the canister body, also takes into account better sealing, the pressure valve can give the thermal insulation canister pressure relief in time, the insulation irrigation will not produce a large pressure difference with the outside world, so that users can easily remove the thermal insulation cover, the design is simple and reasonable, the operation is convenient and fast, to provide users with a better experience of use. Each structure in this design can be completely separated, when you need to clean, you can rotate the lower cover body, the lower cover body and adjusting frame, seals and other parts can be separated in order to clean, easy to clean them.

The above is one or more embodiments provided in combination with the specific contents, and it is not recognized that the specific implementation of the present invention is limited to these descriptions. Any method, structure, etc., similar to or similar to the present invention, or any technical deduction or substitution based on the premise of the concept of the present invention, shall be deemed to be within the scope of protection of the present invention.

What is claimed is:

1. A thermal insulation canister, comprising:

a canister body (1*a*) and a thermal insulation cover (1), wherein the thermal insulation cover (1) is configured to cover the canister body (1*a*); the thermal insulation cover (1) comprises an upper cover body (3), a sealing ring (4), an adjusting frame (5) and a trigger (7), the upper cover body (3) is configured to protect an inner structure of the thermal insulation cover (1); the adjusting frame (5) is configured to pass through the upper cover body (3) and is rotatably connected to the trigger (7); the sealing ring (4) is located between the upper cover body (3) and the adjusting frame (5); when the trigger (7) is turned to drive the adjusting frame (5) to move, then to compress the sealing ring (4), the sealing ring (4) deforms toward a side of the canister body (1*a*), and is in contact with the side of the canister body (1*a*), wherein the thermal insulation cover (1) further comprises an inner cover body (6), a lower end surface of the inner cover body (6) is provided with a sealing gasket (61), the sealing gasket (61) comprises an arc-shaped outer side, a plurality of reinforcing edges (62) are disposed on a lower end surface (6) of the inner cover body (6), and the plurality of reinforcing edges (62) are configured to increase strength of the inner cover body (6).

2. The thermal insulation canister according to claim 1, wherein the upper cover body (3) is provided with an installation hole (72), the trigger (7) is provided with a trigger connecting shaft (71), the trigger connecting shaft (71) is positioned within the installation hole (72) and is slidably connected to the installation hole (72); the adjusting frame (5) is provided with an adjusting shaft (53), one end of the adjusting shaft (53) passes through the installation hole (72) and is rotatably connected with the trigger connecting shaft (71), and the trigger (7) is configured to drive the adjusting frame (5) to move.

3. The thermal insulation canister according to claim 2, wherein the trigger connecting shaft (71) is provided with a protruding portion (7*a*), when the trigger (7) rotates, the protruding portion (7*a*) presses against, an inner wall of the installation hole (72), and the trigger (7) moves with the protruding portion (7*a*) as a fulcrum to drive the trigger connecting shaft (71) to move.

4. The thermal insulation canister according to claim 1, wherein an upper end of the sealing ring (4) is inserted and fixed with a lower end surface of the upper cover body (3), a lower end of the sealing ring (4) is contacted with an upper end surface of the adjusting frame (5).

5. The thermal insulation canister according to claim 4, wherein the lower end surface of the upper cover body (3) is provided with an outer ring groove (33) and an inner ring groove (34), an upper end of the canister body (1*a*) is inserted and fitted with the outer ring groove (33), and the sealing ring (4) is inserted and fitted with the inner ring groove (34).

6. The thermal insulation canister according to claim 5, wherein the adjusting frame (5) comprises an adjusting plate (51) and a bottom plate (52), a thermal insulation layer is located inside the adjusting frame (5), the thermal insulation layer is located between the adjusting plate (51) and the bottom plate (52); the bottom plate (52) is fastened on a lower end surface of the adjusting plate (51), a center of the lower end surface of the adjusting plate (51) is provided with a hollow central shaft (54), the lower end surface of the adjusting plate (51) is further provided with a plurality of spoke edges (55) and a plurality of annular edges (56), the plurality of spoke edges (56) are arranged surrounding the central shaft (54), one end of the spoke edge (55) is connected to the central shaft (54), the other end of the spoke edge (55) extends to an outer edge of the adjusting plate (51), the annular edges (56) connects the plurality of the spoke edges (55), the spoke edges (55) and the annular edges (56) are configured to increase firmness of the adjusting frame (5).

7. The thermal insulation canister according to claim 6, wherein the thermal insulation cover (1) further comprises a pressure valve (9) configured to relieve pressure in the thermal insulation canister, and the pressure valve (9) is located in the central shaft (54).

8. The thermal insulation canister according to claim 1, wherein the canister body (1*a*) further comprises an inner canister body (8) and an outer canister body (2), the inner canister body (8) is located in the outer canister body (2), the inner cover body (6) is disposed on an upper end of the inner canister body (8), the inner cover body (6) clamps with the inner wall of the canister body (1*a*); an inner wall of the outer canister body (2) is provided with a clamping edge (21) protruding inward, an upper end of the inner canister body (8) is provided with a retaining ring (81) folded outward, an outer diameter of the retaining ring (81) is greater than an inner circle diameter of the clamping edge (21), and the retaining ring (81) is in contact with the clamping edge (21).

9. The thermal insulation canister according to claim 8, wherein the outer canister body (2) further comprises an outer casing (23) and an inner casing (24), an interlayer thermal insulation layer is located between the outer casing (23) and the inner casing (24), and the clamping edge (21) is disposed on the inner casing (24).

10. The thermal insulation canister according to claim 5, wherein the upper end of the canister body (1*a*) is bent inward to form a clamping structure (11), when the sealing ring (4) is compressed and deformed, the sealing ring (4) is clamped and fixed with the clamping structure (11).

11. The thermal insulation canister according to claim 10, wherein the clamping structure (11) is plug-fitted into the outer ring groove (33).

12. The thermal insulation canister according to claim 1, wherein the inner cover body (6) further comprises a lower cover plate (65) and a lower annular sleeving plate (66), the lower annular sleeving plate (66) is positioned on an upper end surface of the lower cover plate (65), a diameter of the lower cover plate (65) is greater than a diameter of the lower annular sleeving plate (66), the sealing ring (4) is in contact with an outside of the lower annular sleeving plate (66), and abuts with the upper end surface of the lower cover plate (65).

13. The thermal insulation canister according to claim 12, wherein the lower annular sleeving plate (66) is sleeved on an outside of the adjusting frame (5); an outer clamping stripes (42) and an outer clamping block (43) are fixedly arranged on an outer sidewall of the adjusting frame (5), the outer clamping stripes (42) are arranged obliquely along the outer sidewall of the adjusting frame (5), the outer clamping block (43) is arranged at the highest position of the outer clamping stripes (42), an inner wall of the lower annular sleeving plate (66) is fixed with an inner clamping block (661), the inner clamping block (661) and the outer clamping stripe (42) are slidly connected, each of two sides of the inner clamping block (661) and the outer clamping block (43) is an inclined plane, the inner clamping block (661) and the outer clamping block (43) are connected, so that the adjusting frame (5) and the inner cover body (6) is detachably connected.

14. The thermal insulation canister according to claim 1, wherein the upper cover body (3) is further provided with a handle ring (38), and the handle ring (38) is rotatably connected to the upper cover body (3).

15. The thermal insulation canister according to claim 9, wherein an annular pad (27) is embedded in a lower end surface of the outer casing (23), and the annular pad (27) is fixedly connected to a lowermost end of the outer casing (23).

16. The thermal insulation canister according to claim 1, wherein an upper end surface of the upper cover body (3) is provided with a storage groove (35), the storage groove (35) is configured to place at least one dinnerware.

17. The thermal insulation canister according to claim 16, wherein the storage groove (35) is provided with a storage cover (36), one side of the storage cover (36) is rotatably connected to the storage groove (35), and another side of the storage cover (36) is fastened to the storage groove (35).

* * * * *